US010061241B2

(12) United States Patent
Kanematsu

(10) Patent No.: US 10,061,241 B2
(45) Date of Patent: Aug. 28, 2018

(54) FIXING DEVICE INCLUDING HEATING ROLLER AND IMAGE FORMING APPARATUS

(71) Applicant: KYOCERA Document Solutions Inc., Osaka (JP)

(72) Inventor: Yoshiharu Kanematsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/690,816

(22) Filed: Aug. 30, 2017

(65) Prior Publication Data

US 2018/0113406 A1 Apr. 26, 2018

(30) Foreign Application Priority Data

Oct. 21, 2016 (JP) ..... 2016-207243

(51) Int. Cl.
*G03G 15/20* (2006.01)

(52) U.S. Cl.
CPC . *G03G 15/2053* (2013.01); *G03G 2215/2061* (2013.01); *G03G 2215/2067* (2013.01)

(58) Field of Classification Search
CPC ..... G03G 15/2053; G03G 2215/2058; G03G 2215/2061; G03G 2215/2064; G03G 2215/2067; B30B 3/04
USPC ..... 399/330, 331, 334; 219/216; 492/18, 20, 492/27, 46; 100/176, 328
See application file for complete search history.

(56) References Cited

U.S. PATENT DOCUMENTS 5,092,235 A * 3/1992 Rise ..... G03B 27/32 100/168
5,195,430 A * 3/1993 Rise ..... G03B 27/32 100/168
5,319,430 A * 6/1994 DeBolt ..... G03G 15/2053 100/155 R
5,732,319 A * 3/1998 Komuro ..... G03G 15/206 399/331
5,777,650 A * 7/1998 Blank ..... B41J 2/0057 347/103
7,251,447 B2 * 7/2007 Kanamori ..... G03G 15/2053 219/216

(Continued)

FOREIGN PATENT DOCUMENTS

JP S53-120537 A 10/1978
JP S63-085676 A 4/1988

(Continued)

*Primary Examiner* — Robert Beatty
(74) *Attorney, Agent, or Firm* — Studebaker & Brackett PC

(57) ABSTRACT

A fixing device includes a rotatable cylindrical heating roller, a heat source and a pressing roller. The heat source is arranged in a hollow inner space of the heating roller. The pressing roller is pressed against the heating roller to form a fixing nip through which a sheet is passed in a sheet passing direction. The heating roller has a substrate layer and a heat conductive layer. The substrate layer is formed such that both end portions in a width direction perpendicular to the sheet passing direction are made thinner than a center portion in the width direction, within a sheet passing area through which the sheet is passed. The heat conductive layer is provided around an outer circumferential face of the substrate layer and has a heat conductivity higher than the substrate layer.

9 Claims, 5 Drawing Sheets

(56) References Cited

U.S. PATENT DOCUMENTS 7,974,563 B2 * 7/2011 Sakai ..... G03G 15/2053
399/333

FOREIGN PATENT DOCUMENTS

| | | | | |
|---|---|---|---|---|
| JP | H03-267976 | A | | 11/1991 |
| JP | 2000-112275 | A | | 4/2000 |
| JP | 2001265146 | A | * | 9/2001 |
| JP | 2004264820 | A | * | 9/2004 |
| JP | 2007328101 | A | * | 12/2007 |
| JP | 2009145503 | A | * | 7/2009 |
| JP | 2015152885 | A | * | 8/2015 |

* cited by examiner

FIXING DEVICE INCLUDING HEATING ROLLER AND IMAGE FORMING APPARATUS

INCORPORATION BY REFERENCE

This application is based on and claims the benefit of priority from Japanese Patent application No. 2016-207243 filed on Oct. 21, 2016, which is incorporated by reference in its entirety.

BACKGROUND

The present disclosure relates to a fixing device which fixes a toner image on a sheet and an image forming apparatus including the fixing device.

An image forming apparatus, such as a copying machine and a printer, is provided with a fixing device which fixes a toner image transferred on a sheet to the sheet. A fixing type of the fixing device includes a roller fixing type which employs a heating roller. In the roller fixing type fixing device, a most effective means for improving an energy saving performance is to make the heating roller thin and to decrease its heat capacity. However, the thinner the thickness of the heating roller is, the lower a rigidity of the heating roller is. Then, if the heating roller has a thickness of 0.5 mm or below, high rigid material, such as stainless alloy and iron, has been employed as a substrate layer of the heating roller.

However, such high rigid material including stainless alloy and iron has a heat conductive property lower than aluminum which is conventionally employed as the substrate layer. Thereby, a non-sheet passing area outside a sheet passing area is hardly cooled.

Then, a high heat conductive layer having a heat conductivity higher than the substrate layer may be provided around an outer circumferential face of the substrate layer. Because heat is transferred through the high heat conductive layer in a width direction, a temperature of the heating roller becomes equal in the width direction.

However, in a case where the high heat conductive layer is provided, if a plurality of the sheets are continuously fed and the non-sheet passing area is excessively heated, it is difficult to quickly transfer the heat of the non-sheet passing area.

SUMMARY

In accordance with an aspect of the present disclosure, a fixing device includes a rotatable cylindrical heating roller, a heat source and a pressing roller. The heat source is arranged in a hollow inner space of the heating roller. The pressing roller is pressed against the heating roller to form a fixing nip through which a sheet is passed in a sheet passing direction. The heating roller has a substrate layer and a heat conductive layer. The substrate layer is formed such that both end portions in a width direction perpendicular to the sheet passing direction are made thinner than a center portion in the width direction, within a sheet passing area through which the sheet is passed. The heat conductive layer is provided around an outer circumferential face of the substrate layer and has a heat conductivity higher than the substrate layer.

In accordance with an aspect of the present disclosure, an image forming apparatus includes an image forming part and the above described fixing device. The image forming part forms a toner image on a sheet. The fixing device passes the sheet having the toner image through the fixing nip and fixes the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus and a fixing device according to one embodiment of the present disclosure will be described.

Figure 1:
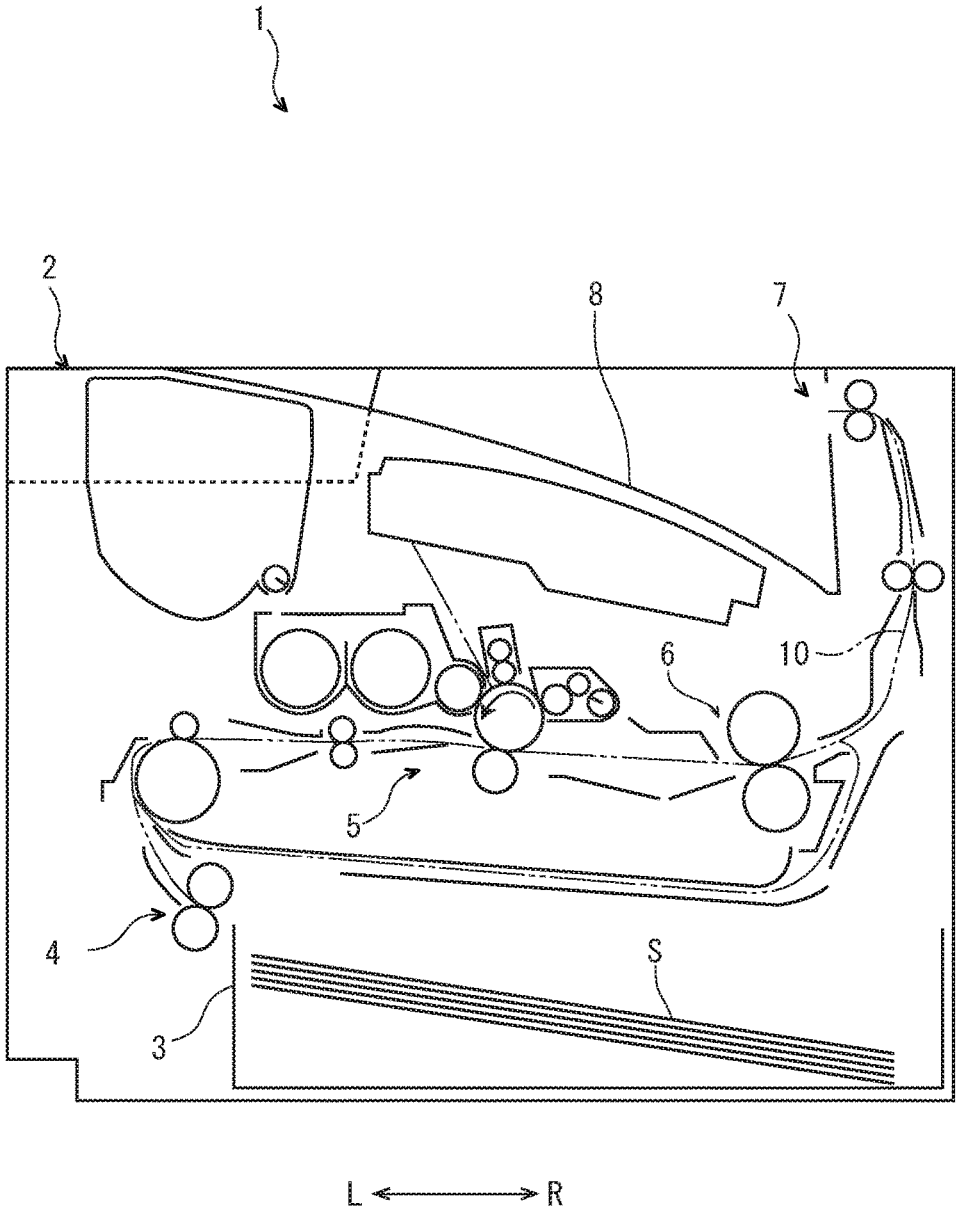
FIG. 1 is a front view schematically showing an inner structure of a printer according to one embodiment of the present disclosure.

With reference to FIG. 1, an entire structure of a printer 1 as the image forming apparatus will be described. FIG. 1 is a view schematically showing an inner structure of the printer 1. In the following description, a near side of a paper plan of FIG. 1 is defined to be a front side of the printer 1, and a left-right direction is defined based on the direction in which the printer 1 is viewed from the front side. Fr, Rr, L and R shown in each figure respectively show the front, rear, left and right sides of the printer 1.

An apparatus main body 2 of the printer 1 includes a sheet feeding cassette 3 in which a sheet S is stored, a sheet feeding device 4 configured to feed the sheet S from the sheet feeding cassette 3, an image forming part 5 configured to form a toner image on the fed sheet S, a fixing device 6 configured to fix the toner image on the sheet S, a sheet ejection device 7 configured to eject the sheet S and an ejected sheet tray 8 configured to receive the ejected sheet S. The apparatus main body 2 includes a conveying path 10 along which the sheet S is conveyed from the sheet feeding device 4 to the sheet ejection device 7 through the image forming part 5 and the fixing device 6.

The sheet S fed from the sheet feeding cassette 3 by the sheet feeding device 4 is conveyed along the conveying path 10 to the image forming part 5. At the image forming part 5, a toner image is formed on the sheet S. Then, the sheet S is conveyed along the conveying path 10 to the fixing device 7. The fixing device 7 fixes the toner image on the sheet S. The sheet S having the fixed toner image is ejected on the ejected sheet tray 8 by the sheet ejection device 7.

Figure 2:
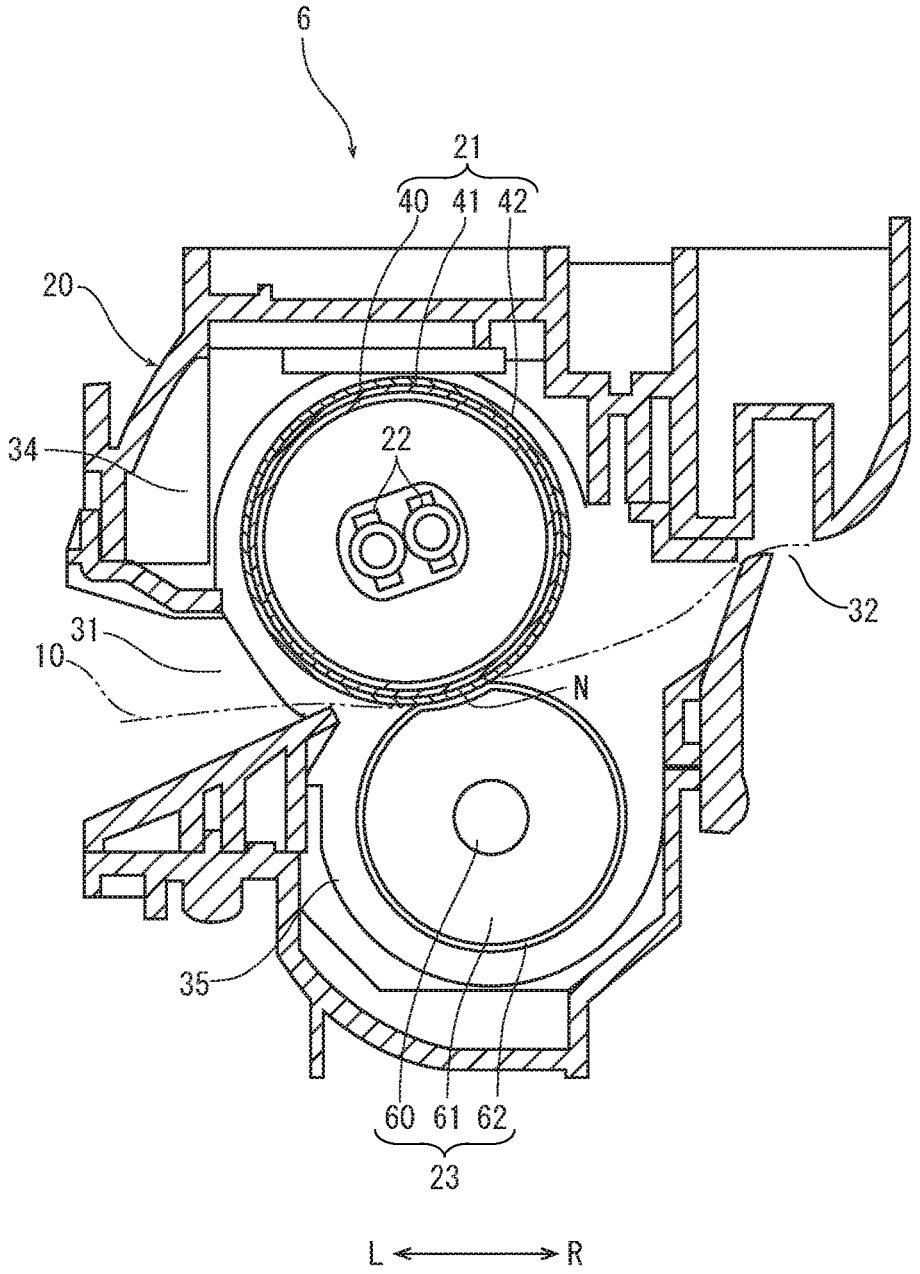
FIG. 2 is a sectional view showing a fixing device according to one embodiment of the present disclosure.

Next, with reference to FIG. 2 and FIG. 3, the fixing device 6 according a first embodiment will be described. FIG. 2 is a sectional view showing the fixing device and FIG. 3 is a sectional view showing a heating roller.

As shown in FIG. 2, the fixing device 6 includes a fixing housing 20, a heating roller 21, two halogen heaters 22 and a pressing roller 23. The heating roller 21 is supported by the fixing housing 20 in a rotatable manner. The two halogen heaters 22 as an example of a heat source is provided in a hollow inner space of the heating roller 21. The pressing roller 23 is supported by the fixing housing 20 and is pressed against the heating roller 21.

The fixing housing 20 is an approximately parallelepiped rectangular shaped hollow member long in the front-rear direction. On a left side face of the fixing housing 20, a receiving port 31 through which the sheet S is received is formed along a width direction (refer to X, in figures) perpendicular to a conveying direction (a passing direction) of the sheet S. On a right side face of the fixing housing 20, a discharging port 32 through which the sheet S is discharged is formed along the width direction. From the receiving port 31 to the discharging port 32, the conveying path 10 is extended. Inside the fixing housing 20, a heating roller storage recess 34 and a pressing roller storage recess 35 are formed above and below the conveying path 10, respectively.

Figure 3:
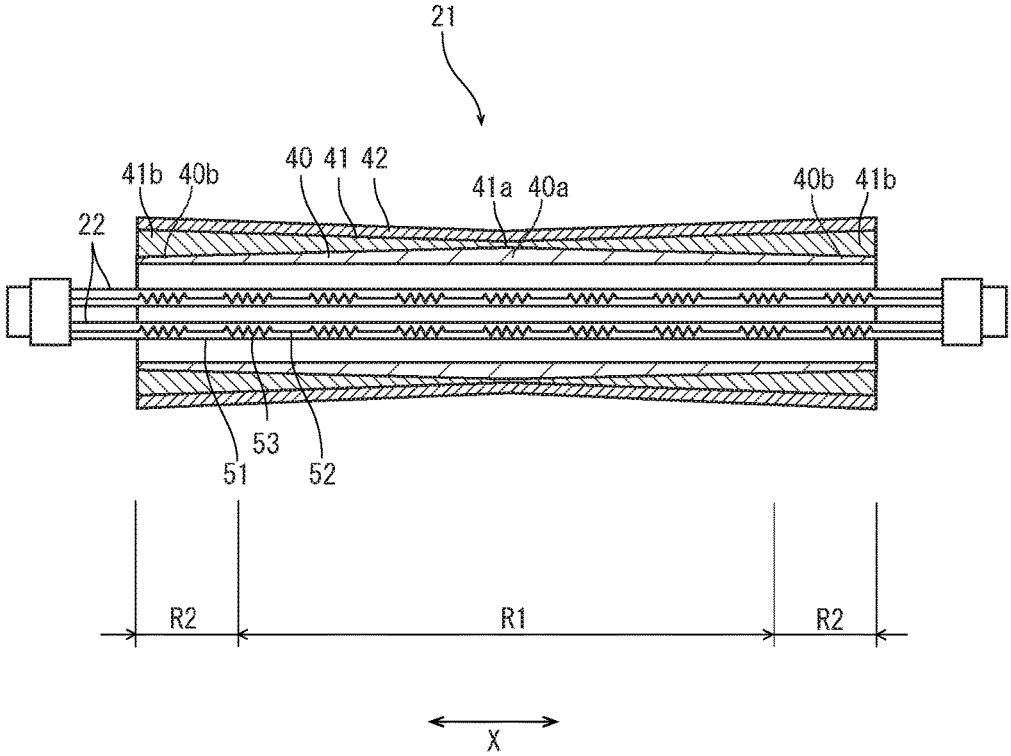
FIG. 3 is a sectional view showing a heating roller of the fixing device according to a first embodiment of the present disclosure.

As shown in FIG. 3, the heating roller 21 has a cylindrical substrate layer 40, a heat conductive layer 41 provided around an outer circumferential face of the substrate layer 40 and a releasing layer 42 provided around an outer circumferential face of the heat conductive layer 41. The heating roller 21 has a width wider than a width of a sheet passing area R1 through which the sheet S is passed. Both outer ends of the sheet passing area R1 in the width direction are non-sheet passing areas R2 through which the sheet S is not passed.

The substrate layer 40 is made of high rigid metal, such as stainless alloy, iron and steel. The substrate layer 40 is formed such that both end portions 40*b* in the width direction are made thinner than a center portion 40*a* in the width direction. The thickness is gradually decreased from the center portion 40*a* to the both end portions 40*b*. In detail, an inner diameter of the substrate layer 40 is constant in the width direction, and an outer diameter of the substrate layer 40 is gradually decreased from the center portion 40*a* to the both end portions 40*b* so that the substrate layer 40 is formed into a crown shape. The thickest portion in the center potion 40*a* has a thickness of 0.3 mm, for example. The thinnest portion of each end portion 40*b* has a thickness of 0.1 mm, for example.

The heat conductive layer 41 is made of high heat conductive material, such as aluminum, copper and silver, having a heat conductivity higher than the substrate layer 40. The heat conductivity of the heat conductive layer 41 is 236 W/m·k, for example. Preferable material for the heat conductive layer 41 is aluminum (A1070), copper and silver. The heat conductive layer 41 is formed such that both end portions 41*b* in the width direction are made thicker than a center portion 41*a* in the width direction. The thickness is gradually increased from the center portion 41*a* to the both end portions 41*b*. Additionally, an outer diameter of the heat conductive layer 41 is gradually increased from the center portion 41*a* to the both end portions 41*b* so that the heat conductive layer 41 is formed into an inverted crown shape. The thinnest portion in the center portion 41*a* has a thickness of 10 to 30 μm, for example and the thickest portion in each end portion 41*b* has a thickness of 30 to 100 μm, for example.

The thicknesses of the center portion 41*a* and the end portion 41*b* of the heat conductive layer 41, and a thickness ratio of the both end portions 41*b* to the center portion 41*a* of the heat conductive layer 41 are set according to the heat conductivity of the substrate layer 40. For example, according the heat conductivity of the substrate layer 40, it becomes possible to increase the thickness of the end portion 41*b* to three times of the thickness of the center portion 41*a* at the maximum. In a case where the heat conductivity of the substrate layer 40 is comparatively high, the center portion 41*a* and the end portions 41*b* are set to be thin, and the thickness ratio of the both end portions 41*b* to the center portion 41*a* is set to be small. On the contrary, in a case where the heat conductivity of the substrate layer 40 is comparatively low, the center portion 41*a* and the end portions 41*b* are set to be thick, and the thickness ratio of the both end portions 41*b* to the center portion 41*a* is set to be large.

When the aluminum is employed as the material of the heat conductive layer 41, fused aluminum particles are splayed on the outer circumferential face of the substrate layer 40 to form the heat conductive layer 41. The aluminum particles are solidified and adhered on the outer circumferential face of the substrate layer 40 in a roughened state in which fine unevenness are formed on the outer circumferential face of the substrate layer 40. When the copper is employed as the material of the heat conductive layer 41, the heat conductive layer 41 is formed by copper plating. In this case, the outer circumferential face of the heat conductive layer 41 is preferably subjected to sandblast treatment to be roughened.

The releasing layer 42 is made of tetrafluoroethylene/perfluoroalkylvinyl ether copolymer (PFA) tube, for example. The releasing layer 42 has a constant thickness in the width direction. Thereby, the outer circumferential face of the heating roller 21 follows the outer circumferential face of the heat conductive layer 41, and the heating roller 21 is formed into an inverted crown shape such that an outer diameter is gradually increased from a center portion to both end portions in the width direction.

The releasing layer 42 is formed around the outer circumferential face of the heat conductive layer 41 by adhesion. When the releasing layer 42 is adhered around the outer circumferential face of the heat conductive layer 41, if the outer circumferential face of the heat conductive layer 41 is roughened, a good adhesion performance can be obtained because a contact area between the releasing layer 42 and the heat conductive layer 41 is increased. Additionally, because the fine unevenness on the outer circumferential face of the heat conductive layer 41 exhibits an anchor effect, the adhesion performance is further improved.

The heating roller 21 is stored in the heating roller storage recess 34 of the fixing housing 20, and both end portions of the heating roller 21 in the width direction are supported by bearings (not shown) in a rotatable manner.

Each halogen heater 22 has a glass tube 51 and a filament 52. The glass tube 51 has a length longer than the heating roller 21. The filament 52 is arranged in the glass tube 51 in a length direction of the glass tube 51. The glass tube 51 is filled with a halogen gas. The filament 52 has a plurality of coiled light-emitting portions 53 separated at predetermined intervals. An area where the light-emitting portions 53 are arranged is a heating area. The light-emitting portions 53 are arranged within the width of the heating roller 21. The halogen heater 22 radiates heat to an inner circumferential face of the heating roller 21 (an inner circumferential face of the substrate layer 40) to heat the heating roller 21.

As shown in FIG. 2, the pressing roller 23 has a columnar core metal 60, an elastic layer 61 provided around an outer circumferential face of the core metal 60 and a releasing layer 62 provided around an outer circumferential face of the elastic layer 61. The core metal 60 is made of metal, such as stainless alloy, for example. The elastic layer 61 is made of silicon rubber, for example. The releasing layer 62 is made of PFA tube, for example.

The pressing roller 23 is supported in the pressing roller storage recess 35 of the fixing housing 20 in a rotatable manner, and is pressed against the heating roller 21. Thereby, between the heating roller 21 and the pressing roller 23, a fixing nip N is formed. On one end portion of the core metal 60 of the pressing roller 23, a drive gear (not shown) to which driving force is transmitted from a driving source, such as a motor, is fixed. When the drive gear is driven, the pressing roller 23 is rotated in the clockwise direction of FIG. 2. Then, the heating roller 21 is driven to be rotated in an opposite direction to the rotating direction of the pressing roller 23. Alternatively, the heating roller 21 may be driven by a driving source to be rotated.

In the fixing device 6 having the above described configuration, when the halogen heaters 22 are activated, the halogen heaters 22 radiate heat to heat the substrate layer 40. The heat is transmitted via the heat conductive layer 41 and the releasing layer 42 to the sheet S conveyed through the fixing nip N. At the fixing nip N, the sheet S is heated and pressed, and the toner image is fixed on the sheet S.

At the fixing nip N, a temperature in the sheet passing area R1 decreases because the heat is absorbed by the sheet S conveyed through the sheet passing area R1. However, a temperature in the non-sheet passing area R2 does not decrease because the heat is not absorbed by the sheet S. If the sheets S are continuously conveyed, the temperature in the non-sheet passing area R2 gradually increases. When the temperature in the non-sheet passing area R2 increases, the heat is transferred in the heat conductive layer 41 in an area direction (the width direction and a circumferential direction) and a thickness direction. Because the heat conductive layer 41 is formed such that the both end portions 41*b* are made thicker than the center portion 41*a*, the heat is accumulated in the both end portions 41*b* larger than the center portion 41*a*, and a heat uniformity is more improved in the both end portions 41*b* than the center portion 41*a*. When differences in the accumulated heat and the heat uniformity between the both end portions 41*b* and the center portion 41*a* become large, the heat transferring from the end portions 41*b* to the center portion 40*a* is accelerated so that the heat conductive layer 41 is quickly and evenly heated in the width direction. However, if the heat conductive layer 41 is made thick, the heat capacity increases to lower heating efficiency. In the present embodiment, the substrate layer 40 is formed such that the both end portions 40*b* are made thinner than the center portion 40*a*. This decreases the heat capacity of the both end portions 40*b* of the substrate layer 40 and relatively increases the heat capacity of the both end portions 41*b* of the heat conductive layer 41 so that it is not necessary to make the both end portions 41*b* of the heat conductive layer 41 thick excessively. The thicknesses of the end portions 41*b* and the center portion 41*a* and the thickness ratio of the heat conductive layer 41 are suitably set according to the heat conductivity of the substrate layer 40, as described above. For example, when the heat conductivity of the substrate later 40 is relatively low, the center portion 41*a* and the end portions 41*b* of the conductive layer 41 are set to be thick, and the thickness ratio of the both end portions 41*b* to the center portion 41*a* is set to be large. This may accelerate the heat transferring in the heat conductive layer 41.

As described above, in the fixing device 6 of the present disclosure, if the temperature in the non-sheet passing area R1 increases, the heat is rapidly and evenly transferred in the heat conductive layer 41 in the width direction so that it becomes possible to prevent the non-sheet passing area R2 from being excessively heated. Additionally, the substrate layer 40 is formed such that the both end portions 40*b* are made thinner than the center potion 40*a*. This prevents the heat conductive layer 41 from being thick and increasing in heat capacity.

In the present embodiment, the heat conductive layer 41 is formed such that the both end portions 41*b* are made thicker than the center portion 41*a*. However, if the substrate layer 40 may be formed such that the center portion 40*a* is made thinner than the both end portions 40*b*, the heat conductive layer 41 may have a constant thickness in the width direction. In this case, the heat capacity of the both end portions 40*b* of the substrate layer 40 is increased and the heat capacity of the both end portions 41*b* of the heat conductive layer 41 is relatively decreased. Thereby, a difference in heat capacity between the center portion 41*a* and the both end portions 41*b* of the heat conductive layer 41 is produced so that the heat is transferred between the center portion 41*a* and the both end portions 41*b*. This makes it possible to heat the conductive layer 41 quickly and evenly.

Accordingly, the substrate layer 40 can be made of material having a high rigidity while not having a high heat conductivity, such as stainless alloy. This makes it possible to make the substrate layer 40 thin and the heat capacity of the substrate later 40 low so that the heating roller 21 can have an improved energy saving performance.

Additionally, because the heating roller 21 is formed into an inverted crown shape, it becomes possible to prevent the sheet S conveyed through the fixing nip N being wrinkled.

Because a plurality of fine unevenness are formed on the outer circumferential face of the heat conductive layer 41, the adhesion performance of the releasing layer 42 to the heat conductive layer 41 can be improved.

Figure 4:
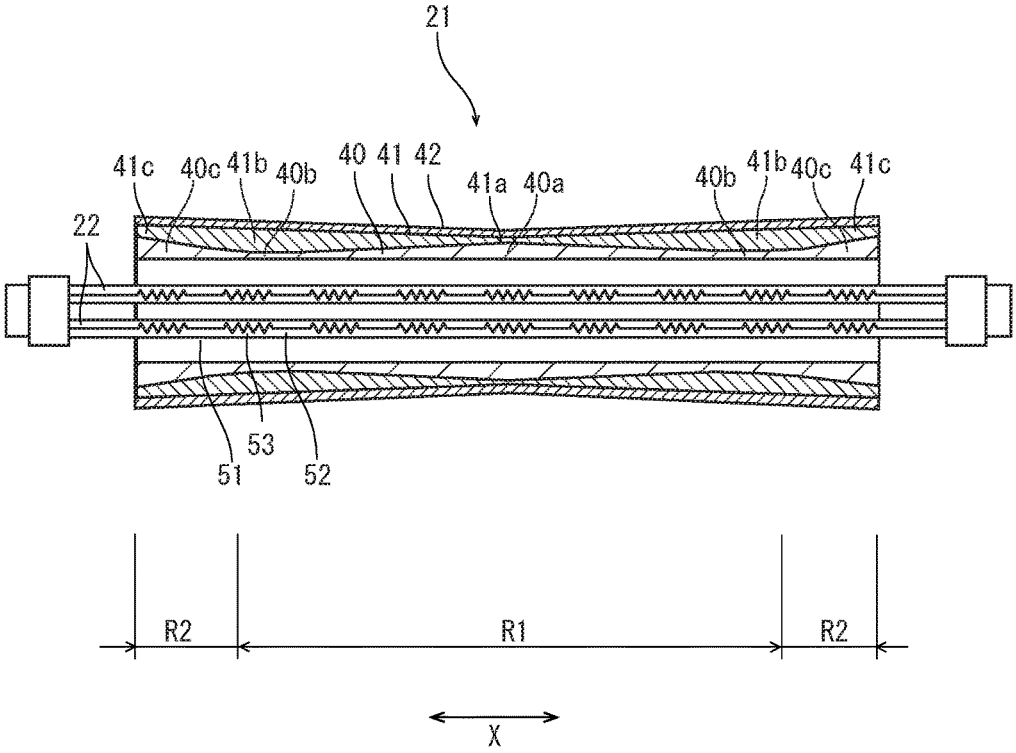
FIG. 4 is a sectional view showing a heating roller of the fixing device according to a second embodiment of the present disclosure.
Figure 5:
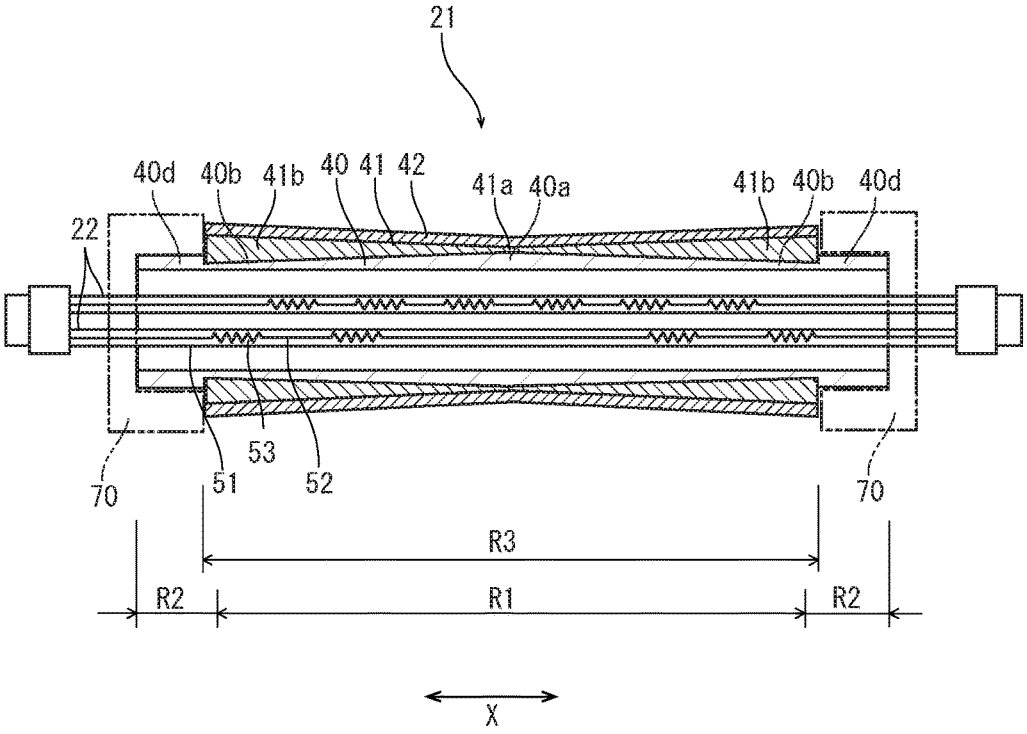
FIG. 5 is a sectional view showing a heating roller of the fixing device according to a third embodiment of the present disclosure.

Next, with reference to FIG. 4, the heating roller 21 of the fixing device according to a second embodiment will be described. FIG. 4 is a sectional view showing the heating roller.

The heating roller 21 has a cylindrical substrate layer 40, a heat conductive layer 41 provided around an outer circumferential face of the substrate layer 40 and a releasing layer 42 provided around an outer circumferential face of the heat conductive layer 41, as the same as the first embodiment.

In the second embodiment, within the sheet passing area R1, the substrate layer 40 is made gradually thinner from a center portion 40*a* to both end portions 40*b*. On the contrary, within the non-sheet passing areas R2, outermost end portions 40*c* of the substrate layer 40 are made gradually thicker toward both ends.

Additionally, within the sheet passing area R1, the conductive layer 41 is made gradually thicker from a center portion 41*a* to both end portions 41*b*. On the contrary, within the non-sheet passing areas R2, outermost end portions 41*c* of the heat conductive layer 41 are made gradually thinner toward both ends. An outer diameter of the heat conductive layer 41 is gradually increased from the center portion 41*a* to the both outermost end portions 41*c* so that the heat conductive layer 41 is formed into an inverted crown shape.

As described above, in the second embodiment, because the outermost end portions 40*c* of the substrate layer 40 are made thick, it becomes possible to enhance the rigidity of the outermost end portions 40*c*. Thereby, when the outermost end portions 40*c* of the heating roller 21 are supported by the bearings, a rigidity against rotation torque of the heating roller 21 can be obtained.

Next, with reference to FIG. 4, the heating roller 21 of the fixing device 6 of a third embodiment will be described. FIG. 4 is a sectional view showing the heating roller.

The heating roller 21 has a cylindrical substrate layer 40, a heat conductive layer 41 provided around an outer circumferential face of the substrate layer 40 and a releasing layer 42 provided around an outer circumferential face of the heat conductive layer 41, as the same as the first embodiment.

In the third embodiment, an area R3 (a heat conductive layer forming area) where the heat conductive layer 41 is formed has a width narrower than the width of the substrate layer 40. In detail, the width of the heat conductive layer forming area R3 is slightly wider than the width of the sheet passing area R1, and both ends of the heat conductive layer forming area R3 in the width direction are separated outward from both ends of the sheet passing area R1 in the width direction. Thereby, on both outer sides of the heat conductive layer forming area R3 in the width direction, supported portions 40*d* where the substrate layer 40 is exposed are formed. In other ward, the heat conductive layer forming area R3 is formed inside the both supported portions 40*d* in the width direction. The supported portions 40*d* are supported by the bearings 70 of the heating roller storage recess 34 in a rotatable manner.

Within the heat conductive layer forming area R3, the substrate layer 40 is made thinner from a center portion 40*a* to both end portions 40*b*. On the contrary, on the both outer sides of the heat conductive layer forming area R3, the supported portions 40*d* of the substrate layer 40 are made to have a constant thickness thicker than the thinnest portion of the end portion 40*b*.

The heat conductive layer 41 is made gradually thicker from a center portion 41*a* to both end portions 41*b*. An outer diameter of the heat conductive layer 41 is gradually increased from the center portion 41*a* to the both end portions 41*b* so that the heat conductive layer 41 id formed into an inverted crown shape.

The light-emitting portions 53 of the halogen heater 22 are arranged within the heat conductive layer forming area R3. In detail, the light-emitting portions 53 of one of the halogen heaters 22 (one heater) are arranged in a center portion of the heat conductive layer forming area R3, and the light emitting portions 53 of the other of the halogen heaters 22 (the other heater) are arranged in both end portions of the heat conductive layer forming area R3. Both outer end portions of the light-emitting portion 53 of the one halogen heater 22 are overlapped to both inner end portions of the light-emitting portions 53 of the other halogen heater 22.

Because the light-emitting portions 53 of the two halogen heaters 22 are displaced each other, the halogen heaters 22 are properly used according to a width of the sheet S to vary the heating area. That is, if the maximum size sheet S is passed, the both halogen heaters 22 are operated to heat the heat conductive layer forming area R3. If the sheet S whose width is narrower than the maximum size sheet is passed, the one halogen heater 22 is operated to heat an area narrower than the heat conductive layer forming area R3. Because the heat conductive layer forming area R3 has the width slightly wider than the width of the sheet passing area R1, when the heat conductive layer forming area R3 is heated, it becomes possible to heat an entire area of the sheet passing area R1 surely.

In the fixing device 6 having the configuration described above, an area heated by the halogen heaters 22 can be narrow as much as possible so that it becomes possible to prevent the non-sheet passing area R2 being heated excessively. Additionally, the energy saving performance of the halogen heaters 22 can be improved.

The supported portions 40*d* of the substrate layer 40 are supported by the bearings 70 in the heating roller storage recess 34. Because the light-emitting portions 53 of the halogen heaters 22 are not arranged in the supported portions 40*d*, the supported portions 40*d* are not heated by the halogen heaters 22. Additionally, the substrate layer 40 has a low heat conductivity so that the heat is not transferred to the supported portions 40*d* and the supported portions 40*d* are therefore not heated. If the supported portions 40*d* may be heated, a friction with the bearing 70 may become large to increase the rotation torque, and the property of the bearing portion 70 may be deteriorated to shorten its life. In the present embodiment, because a temperature of the supported portions 40*d* are not increased, it becomes possible to prevent the increasing of the rotation torque and to prolong the life of the supported portions 40*d*. Furthermore, if the bearing 70 may contain a lubricant, it becomes possible to prevent the lubricant from being volatized.

While the preferable embodiment and its modified example of the fixing device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. A fixing device comprising:

a rotatable cylindrical heating roller, a heat source arranged in a hollow inner space of the heating roller, and a pressing roller pressed against the heating roller to form a fixing nip through which a sheet is passed in a sheet passing direction, wherein the heating roller has a substrate layer formed such that both end portions in a width direction perpendicular to the sheet passing direction are made thinner than a center portion in the width direction, within a sheet passing area through which the sheet is passed, and a heat conductive layer provided around an outer circumferential face of the substrate layer and having a heat conductivity higher than the substrate layer, and the substrate layer is thicker at non-sheet passing areas on both outer sides of the sheet passing area in the width direction than at both end portions of the sheet passing area in the width direction.

2. The fixing device according to claim 1, wherein the heat conductive layer is formed such that both end portions in the width direction are made thicker than a center portion in the width direction.

3. The fixing device according to claim 1, wherein the heating roller is formed into an inverted crown shape in which an outer diameter is larger at both end portions in the width direction than at a center portion in the width direction.

4. The fixing device according to claim 1, wherein the heating roller has a releasing layer provided around an outer circumferential face of the heat conductive layer, and an outer circumferential face of the heat conductive layer is roughened.

5. The fixing device according to claim 1, wherein the heating roller has supported portions provided at both end portions in the width direction, the supported portion being supported by a bearing, the heat conductive layer is provided inside the supported portions in the width direction, and a heating area of the heat source is provided within a width of the heat conductive layer.

6. The fixing device according to claim 1, wherein the heat conductive layer is made of aluminum, copper or silver.

7. The fixing device according to claim 1, wherein the substrate layer is made of stainless alloy, iron or steel.

8. The fixing device according to claim 1, wherein the heat source has a first heater having a heating area at a center portion in the width direction within the sheet passing area, and a second heater having heating areas at both end portions in the width direction within the sheet passing area.

9. An image forming device comprising:

an image forming part which forms a toner image on a sheet, and the fixing device according to claim 1, which passes the sheet having the toner image through the fixing nip and fixes the toner image on the sheet.

* * * * *